US008401429B2

(12) United States Patent
Murayama

(10) Patent No.: US 8,401,429 B2
(45) Date of Patent: Mar. 19, 2013

(54) IMAGE FORMING APPARATUS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 317 days.

(21) Appl. No.: 12/723,799

(22) Filed: Mar. 15, 2010

(65) Prior Publication Data

US 2011/0076051 A1 Mar. 31, 2011

(30) Foreign Application Priority Data

Sep. 29, 2009 (JP) ..... 2009-224028

(51) Int. Cl.
*G03G 15/00* (2006.01)

(52) U.S. Cl. ..... 399/167

(58) Field of Classification Search ..... 399/167, 399/121, 302
See application file for complete search history.

(56) References Cited

U.S. PATENT DOCUMENTS

| | | | |
|---|---|---|---|
| 6,035,158 | A | 3/2000 | Asakura et al. |
| 2002/0021916 | A1 | 2/2002 | Wakana |
| 2005/0084294 | A1 | 4/2005 | Mizushima et al. |
| 2006/0222401 | A1 | 10/2006 | Kamimura |
| 2007/0048005 | A1 | 3/2007 | Nakano et al. |

FOREIGN PATENT DOCUMENTS

| | | | | |
|---|---|---|---|---|
| JP | 11-174863 | A | | 7/1999 |
| JP | 2000039820 | A | * | 2/2000 |
| JP | 2000-275987 | A | | 10/2000 |
| JP | 2002-060039 | | | 2/2002 |
| JP | 2002-132001 | A | | 5/2002 |
| JP | 2002-0162804 | A | | 6/2002 |
| JP | 2004-0252086 | A | | 9/2004 |
| JP | 2005-077774 | | | 3/2005 |
| JP | 2006-0276447 | A | | 10/2006 |
| JP | 2007-057952 | | | 3/2007 |
| JP | 2008070482 | A | * | 3/2008 |

OTHER PUBLICATIONS

JP Notice of Reasons for Rejection dated Sep. 27, 2011, corresponding Application No. 2009-224028; English Translation.

JP Office Action dtd Nov. 29, 2011, JP Appln. 2009-224028, English translation.

JP Decision of Patent Grant dated Feb. 28, 2012, in corresponding Applicaiton No. 2009-224028; English Translation.

* cited by examiner

*Primary Examiner* — David Gray
*Assistant Examiner* — Erika J Villaluna
(74) *Attorney, Agent, or Firm* — Banner & Witcoff, Ltd.

(57) ABSTRACT

An image forming apparatus includes a belt unit having a driving roller, a driven roller, a driving roller gear; and a belt which is looped around the driving roller and the driven roller; a belt driving gear which is engaged with the driving roller gear; a photosensitive drum which contacts the belt; and a positioning section which contacts a portion of the belt unit to position the belt unit with respect to a moving direction of the belt. The positioning section contacts the portion of the belt unit in a direction of receiving a force with which the photosensitive drum is pressing the belt unit. The belt driving gear is engaged with the driving roller gear such that a force pressing the belt unit from the belt driving gear via the driving roller gear presses the belt unit against the positioning section.

9 Claims, 6 Drawing Sheets

IMAGE FORMING APPARATUS

CROSS-REFERENCE TO RELATED APPLICATION

This application claims priority from Japanese Patent Application No. 2009-224028, filed on Sep. 29, 2009, the entire subject matter of which is incorporated herein by reference.

TECHNICAL FIELD

Aspects of the present invention relate to an image forming apparatus.

BACKGROUND

An electrophotographic image forming apparatus uses a belt unit to transport a recording sheet. The belt unit is provided to oppose a photosensitive drum, wherein a toner image is transferred from the photosensitive drum to the recording sheet transported by the belt unit. In addition, when an intermediate transfer belt is used in a belt unit temporarily holding the toner image to be formed on the recording sheet, the belt unit is also provided to oppose a photosensitive drum.

Then, these belt units have to be accurately positioned with respect to an apparatus body in order to form a toner image at an accurate position with respect to a recording sheet and, in case of color printing, in order to prevent occurrence of color shift. For example, in an image forming apparatus, the position of the belt in its moving direction is defined by pressing the bearing of a roller, around which the belt is looped, against a positioning section of a frame.

However, in the image forming apparatus, due to the setting of the operating timing or the peripheral speed of the belt or the photosensitive drum, a force acts to move the belt from the photosensitive drum toward the belt unit. In this image forming apparatus, since this force acts in a direction of separating the bearing of the belt unit away from the positioning section, there is a possibility that the position of the belt in the moving direction of the belt would become unstable.

SUMMARY

Accordingly, it is an aspect of the present invention to provide an image forming apparatus which allows the position of the belt unit with respect to a moving direction of a belt to be stable.

According to an illustrative embodiment of the present invention, there is provided an image forming apparatus comprising: a belt unit including a driving roller, a driven roller, a driving roller gear which is coaxial with the driving roller, and a belt which is looped around the driving roller and the driven roller; a belt driving gear which is engaged with the driving roller gear to transmit a driving force to the driving roller; a photosensitive drum which is configured to rotate while contacting the belt; and a positioning section which is provided to an apparatus body and configured to contact a portion of the belt unit to position the belt unit with respect to a moving direction of the belt. The positioning section is configured to contact the portion of the belt unit in a direction of receiving a force with which the photosensitive drum is pressing the belt unit. The belt driving gear is engaged with the driving roller gear such that a force pressing the belt unit from the belt driving gear via the driving roller gear presses the belt unit against the positioning section.

According to another illustrative embodiment of the present invention, there is provided an image forming apparatus comprising: an apparatus body; a belt unit including a driving roller, a driven roller, a driving roller gear which is coaxial with the driving roller, and a belt which is looped around the driving roller and the driven roller; a belt driving gear which is provided to the apparatus body and is engaged with the driving roller gear; a photosensitive drum which is configured to rotate while contacting the belt; and an abutting section which is provided to the apparatus body at a position configured to contact a portion of the belt unit from a direction opposite to a rotating direction of the photosensitive drum at a contacting point with the belt. The belt driving gear is engaged with the driving roller gear such that an angle formed between a direction extending form a center of the belt driving gear to a center of the driving roller gear and a moving direction of the belt at a contacting point with the photosensitive drum is larger than a pressure angle of the belt driving gear.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1:
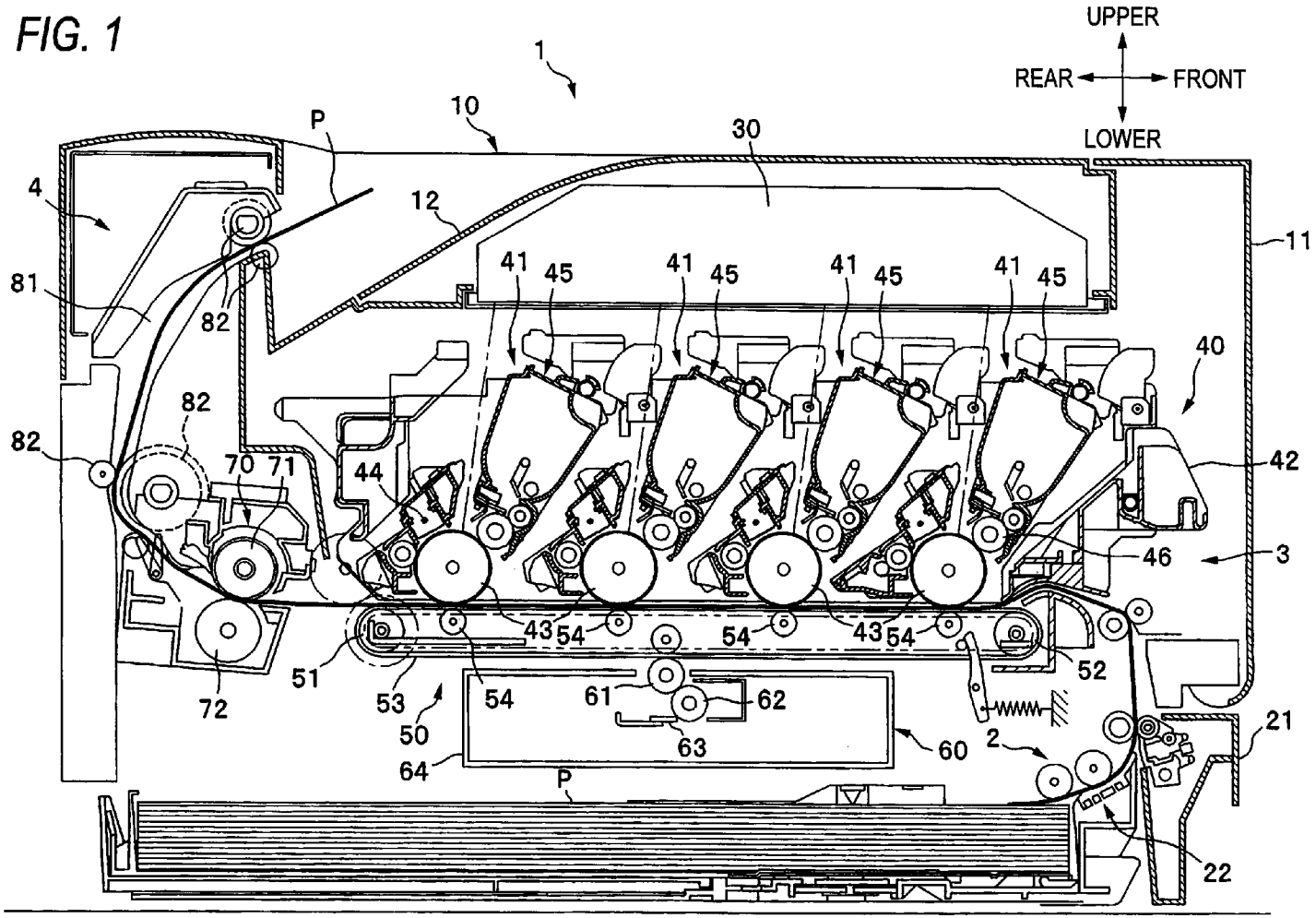
FIG. 1 is a sectional view showing a schematic configuration of an image forming apparatus according to an illustrative embodiment.

Illustrative embodiments of the present invention will be described with reference to the accompanying drawings. A color printer 1 is shown in FIG. 1 as an example of an image forming apparatus according to an illustrative embodiment of the present invention. For ease of discussion, in the following description, directions are defined as viewed from a user who operates the printer 1. The top or upper side, the bottom or lower side, the left or left side, the right or right side, the front or front side, and the rear or rear side of the printer 1 are identified as indicated by the arrows in drawings. Further, herein the left-right direction is also referred to as a width direction, and the upper-lower direction is also referred to as a vertical direction. The left-right direction and the front-rear direction are also referred to as a horizontal direction. With regard to various individual components of the printer 1, sides of the individual components are similarly identified based on the arranged/attached position of the components on/in the printer 1.

Overall Configuration of Color Printer

As shown in FIG. 1, the color printer 1 includes a body housing 10 constituting a portion of an apparatus body, a sheet feeding section 2 which feeds a sheet P, an image forming section 3 which forms an image on the fed sheet P, and a sheet discharging section 4 which discharges the sheet P on which the image has been formed.

The sheet feeding section 2 is provided at a lower part in the body housing 10, and includes a sheet tray 21 in which sheets P are accommodated and a sheet feeding mechanism 22 which feeds sheet P from the sheet tray 21 to the image forming section 3. Sheets P in the sheet tray 21 are separated one by one and fed to the image forming section 3 by the sheet feeding mechanism 22.

The image forming section 3 includes an exposure unit 30, an image forming unit 40, a belt unit 50, a belt cleaner 60 and a fixing unit 70.

The exposure unit 30 is provided at an upper part in the body housing 10 and includes a laser light emitting section, a polygon mirror, lenses, a reflective mirror and the like (not shown). Laser light emitted from the laser light emitting section for each of cyan, magenta, yellow and black colors is reflected by the polygon mirror or the reflective mirror, passes through the lenses, and then are irradiated onto the surface of corresponding photosensitive drum 43 as a high speed scanning.

The image forming unit 40 is provided between the sheet feeding section 2 and the exposure unit 30, and includes four process units 41 and a supporting member 42 supporting the four process units 41 in a state in which these process units 41 are aligned in the front-rear direction.

The process unit 41 includes a photosensitive drum 43, a charger 44 and a developing cartridge 45. The developing cartridge 45 includes a developing roller 46 and a supply roller, a layer thickness regulating blade and a toner accommodating section (reference numerals are omitted).

The belt unit 50 is provided between the sheet feeding section 2 and the image forming unit 40, and includes a driving roller 51, a driven roller 52, an endless transport belt 53 which is looped around the driving roller 51 and the driven roller 52, and four transfer rollers 54. An outside surface of the transport belt 53 contacts each of the photosensitive drums 43. In an inside of the transport belt 53, each of the transfer rollers 54 is provided to interpose the transport belt 53 with the corresponding photosensitive drum 43. Furthermore, the belt unit 50 is configured to be removably from the body housing 10.

The fixing unit 70 is provided at a rear side of the image forming unit 40 and the belt unit 50, and includes a heating roller 71 and a pressing roller 72 which opposes the heating roller 71 to press the heating roller 71.

In the image forming section 3, after the surface of the photosensitive drum 43 is uniformly charged by the charger 44, it is exposed by high speed scanning of the laser light from the exposure unit 30, so that an electrostatic latent image is formed on the photosensitive drum 43. Toner in the toner accommodating section is supplied to the developing roller 46 via the supply roller and enters between the developing roller 46 and the layer thickness regulating blade to be held on the developing roller 46 as a thin layer of a predetermined thickness.

The toner held on the developing roller 46 is supplied from the developing roller 46 to the electrostatic latent image on the photosensitive drum 43. Accordingly, the electrostatic latent image is visualized into a toner image on the photosensitive drum 43. When the sheet P fed onto the transport belt 53 is transported between the photosensitive drums 43 and the transport belt 53 (the transfer rollers 54), the toner image formed on each of the photosensitive drums 43 is sequentially transferred onto the sheet P in an overlapping manner. Then, when the sheet P is transported between the heating roller 71 and the pressing roller 72, the toner image transferred onto the sheet P is fixed by heating.

The sheet discharging section 4 includes a sheet discharging path 81 formed to extend upwards from the fixing unit 70 and change its direction in a forward direction, and a plurality of transport rollers 82 which transport the sheet P. The sheet P on which the toner image has been fixed by heating is transported along the sheet discharging path 81 by the transport rollers 82 and is discharged onto the sheet discharging tray 12 provided at an upper surface of the body housing 10.

A front side of the body housing 10 is defined by a front cover 11 which can be opened or closed, and the image forming unit 40 and the belt unit 50 can be removed to outside of the body housing 10 by opening the front cover 11.

Detailed Configuration of the Periphery of Belt Unit

Next, the detailed configuration of the periphery of the belt unit 50 will be described with respect to FIGS. 2 and 3. The transport belt 53 is looped around the driving roller 51 and the driven roller 52 as described above, and an upper side of the transport belt 53 (hereinafter, referred to as "an upper belt 53A"), contacts each of the photosensitive drums 43 at an outside (upper side) surface thereof. At a time of printing, the photosensitive drums 43 contact the transport belt 53 with the sheet P interposed therebetween.

Herein, in this illustrative embodiment, "a moving direction" of the transport belt 53 indicates a front-rear direction in which the upper belt 53A moves. And, "an advancing direction" of the transport belt 53 indicates a direction in which the upper belt 53A or a lower side of the transport belt 53 (hereinafter, referred to as "a lower belt 53B") actually advances. These directions are distinguished from each other. That is, in this illustrative embodiment, a position in the moving direction means a position in the front-rear direction, the advancing direction of the upper belt 53A means the rearward direction, and the advancing direction of the lower belt 53B means the forward direction.

Figure 2:
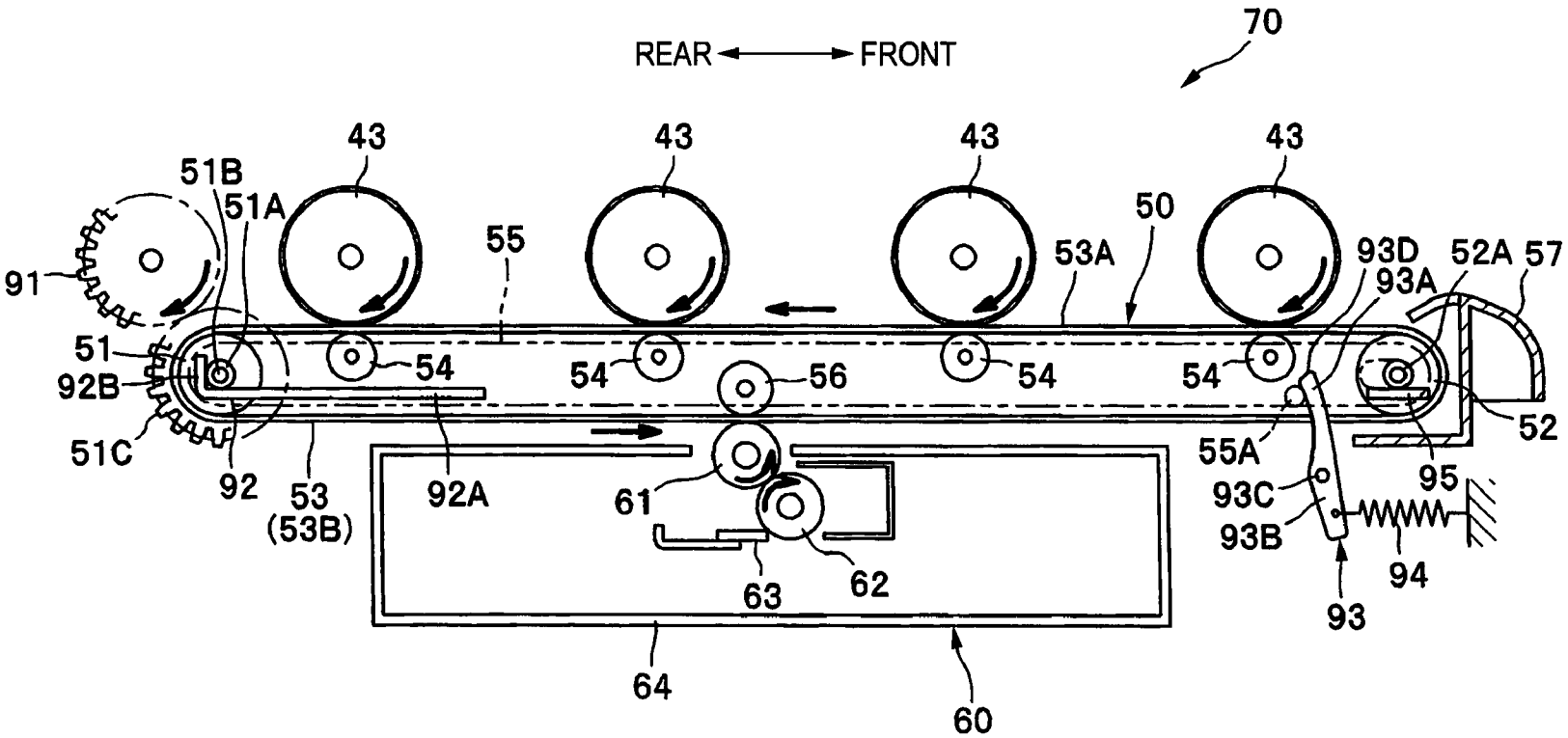
FIG. 2 is an enlarged side view showing the periphery of a belt unit.
Figure 3:
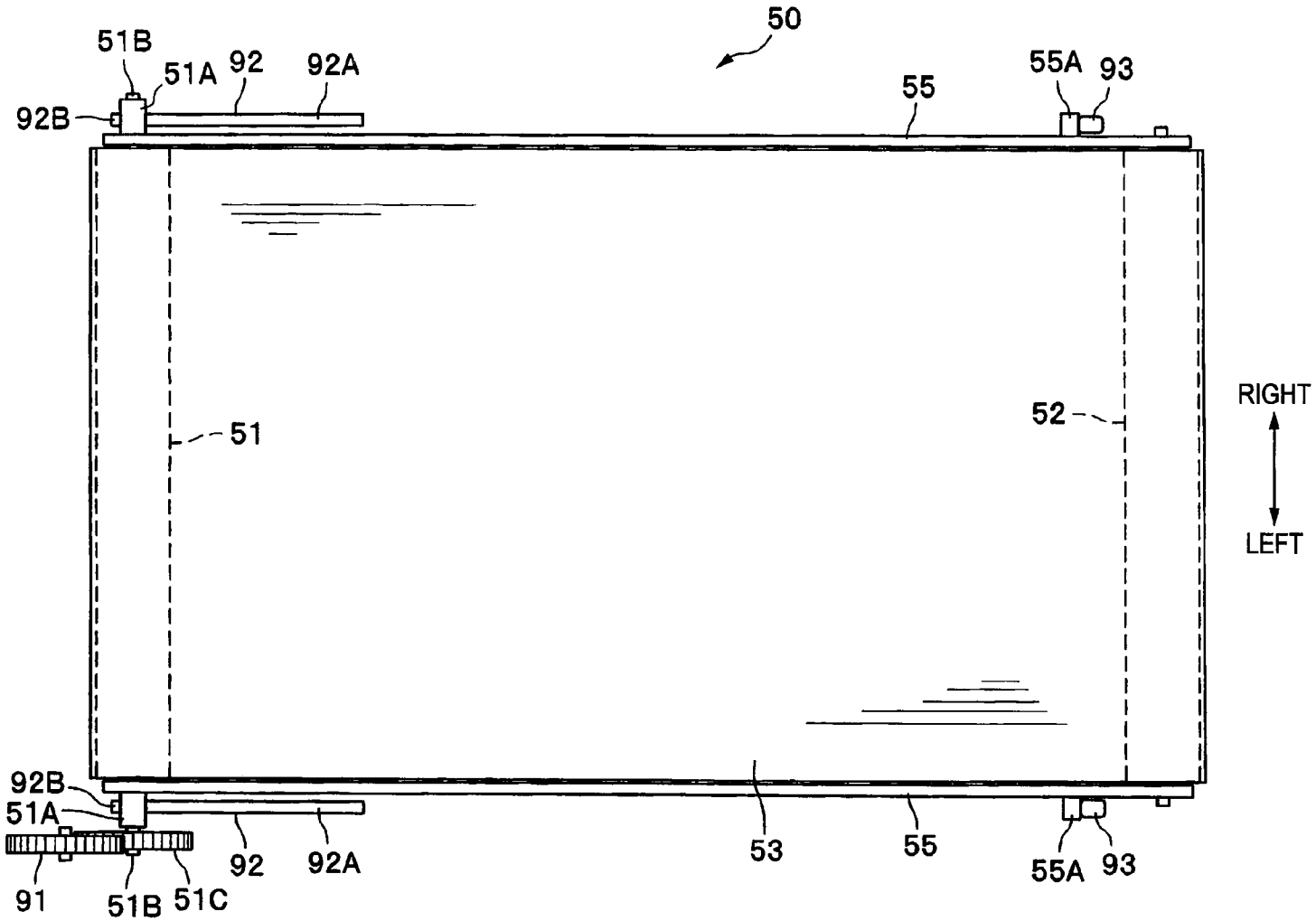
FIG. 3 is an enlarged plan view showing the periphery of the belt unit.

In order to transport the sheet P rearward, the upper belt 53A advances toward the rear side and the photosensitive drums 43 rotate in a clockwise direction in FIG. 2. That is, a portion at which the photosensitive drum 43 contacts the upper belt 53A advances toward the rear side same as the upper belt 53A. A circumferential speed of the photosensitive drum 43 (moving speed of the rotating surface) and that of the transport belt 53 are set to be substantially same. Precisely, the circumferential speed of the photosensitive drum 43 may be set to be slightly smaller than that of the transport belt 53, or the circumferential speed of the photosensitive drum 43 may be set to be slightly larger than that of the transport belt 53. If the circumferential speed of the photosensitive drum 43 is larger than that of the transport belt 53, a force acts in which the photosensitive drum 43 transports the belt unit 50 rearward. This situation may be advantageous as described later.

The driving roller 51 and the driven roller 52 are supported to be rotatable by a frame 55 via bearings 51A and 52A, respectively. In order to apply an appropriate tension to the transport belt 53, the driven roller 52 is urged by a spring (not shown) to be separated form the driving roller 51. That is, the driven roller 52 is supported by the frame 55 to be movable slightly in the front-rear direction.

The bearing 51A and a shaft 51B of the driving roller 51 protrude to both right and left sides. The apparatus body is provided with a positioning rail 92 (as an example of a positioning member) at both right and left sides of the transport belt 53. The positioning rail 92 includes a rail section 92A (as an example of the guide) which extends horizontally in a front-rear rear direction, and an abutting section 92B which extends upward from a rear end of the rail section 92A. A front surface of the abutting section 92B has a vertically extending plane and is configured to receive a force with which the photosensitive drum 43 presses the belt unit 50, that is, a rearward pressing force. The bearing 51A has a length which reaches the positioning rail 92.

The frame 55 includes a lock pin 55A at a front side position thereof. The lock pin 55A protrudes to right and left outsides. In front of the right and left lock pins 55A, a lock member 93 supported by the apparatus body to be pivotable about a shaft 93C which is parallel to the driving roller 51. The lock member 93 includes a first arm 93A extending upward and a second arm 93B extending downward. The second arm 93B is engaged with one end of the spring 94. The other end of the spring 94 is engaged with the apparatus body. The spring 94 always urges the second arm 93B toward the front side, and accordingly, the first arm 93A is urged toward the rear side. The first arm 93A is provided to contact the lock pin 55A of the belt unit 50 mounted in the apparatus body and always urges the belt unit 50 toward the rear side. An upper end face 93D of the first arm 93A has a downward slanted face toward the rear side. When mounting the belt unit 50 into the apparatus body, the upper end face 93D contacts the lock pin 55A descending from above to allow the first arm 93A to move toward the front side, and the bearing 52A is put on a support base 95 provided to the apparatus body so that the position of the bearing 52A in the upper-lower direction is defined.

With such a configuration, when the color printer 1 is not operating, the lock pin 55A is pressed toward the rear side by the first arm 93A, the entire belt unit 50 is pressed toward the rear side, and the bearing 51A contacts the abutting section 92B of the positioning rail 92. Accordingly, the belt unit 50 is positioned in the moving direction of the transport belt 53.

One end (left end) of the shaft 51B of the driving roller 51 is provided with a driving roller gear 51C which is coaxial with the drive roller 51. The driving roller gear 51C is engaged with a belt driving gear 91 at the rear and upper side of the driving roller gear 51C. The belt driving gear 91 is supported to be rotatable by the apparatus body and receives a force from a motor (not shown) to rotate in a clockwise direction in FIG. 2. Accordingly, the driving roller gear 51C engaged with the belt driving gear 91 rotates in a counterclockwise direction in FIG. 2 to rotate the driving roller 51 and the transport belt 53 in a counterclockwise direction.

A front end of the belt unit 50 has a handle 57 fixed to the frame 55. The handle 57 is a part to be gripped in order to remove the belt unit 50 from the apparatus body.

Under the belt unit 50, in other words, on a side of the belt unit 50 opposite to the photosensitive drum 43, a belt cleaner 60 is provided. The belt cleaner 60 includes a cleaning roller 61, a collecting roller 62, a blade 63 and a collecting box 64.

The cleaning roller 61 rotates about a shaft parallel to the driving roller 51 in a counterclockwise direction in FIG. 2 which is opposite to the rotating direction of the photosensitive drum 43 to sliding contact the surface of the lower belt 53B. The cleaning roller 61 sliding contact the lower belt 53B so that the cleaning roller 61 scrapes off the remaining toner or sheet powder on the surface of the transport belt 53. The belt unit 50 further includes a backup roller 56 provided inside of the transport belt 53 to interpose the lower belt 53B with the cleaning roller 61. The backup roller 56 is configured to apply a contact pressure between the lower belt 53B and the cleaning roller 61.

The collecting roller 62 rotates in a clockwise direction in FIG. 2 while sliding contacting the cleaning roller 61 under the cleaning roller 61 to remove the toner attached to the cleaning roller 61.

The blade 63 is provided so that a tip end thereof sliding contacts the collecting roller 62, and scrapes off the toner or the like on the surface of the collecting roller 62 and drops it into the collecting box 64.

Figure 4:
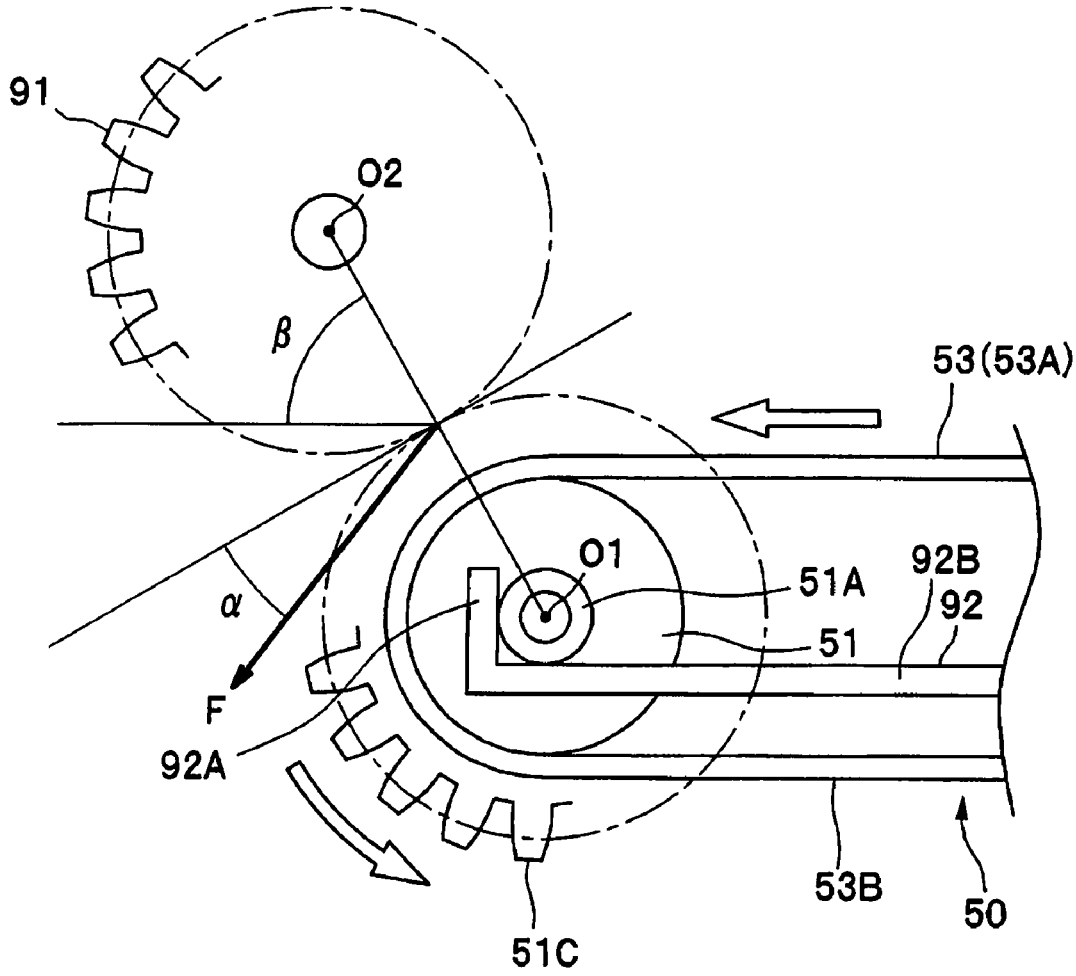
FIG. 4 is an explanatory view showing an arrangement of a belt driving gear.

The arrangement of the belt driving gear 91 will be described with reference to FIG. 4. The belt driving gear 91 is provided to have a relation in which, in the side view, an angle $\beta$ formed between a direction extending from a center O1 of the driving roller gear 51C to a center O2 of the belt driving gear 91 and the advancing direction of the upper belt 53A (a belt contacting the photosensitive drum 43) is larger than a pressure angle $\alpha$ of the belt driving gear 91 ($\beta>\alpha$). In this case, the a force F with which the belt driving gear 91 presses the driving roller gear 51C (that is, the force pressing the belt unit 50) presses the bearing 51A of the belt unit 50 against the abutting section 92B. Specifically, this force F has a component toward the abutting section 92B (left-directing component in FIG. 4) with respect to the front-rear direction. Herein, the pressure angle indicates an angle formed between a radial direction of the of the belt driving gear 91 and a tangential direction of a tooth surface of the belt driving gear 91 at a point (a pitch point in general) of the tooth surface.

Next, a mounting operation and a movement of the belt unit 50 in the above-described printer 1 will be described.

Figure 5A:
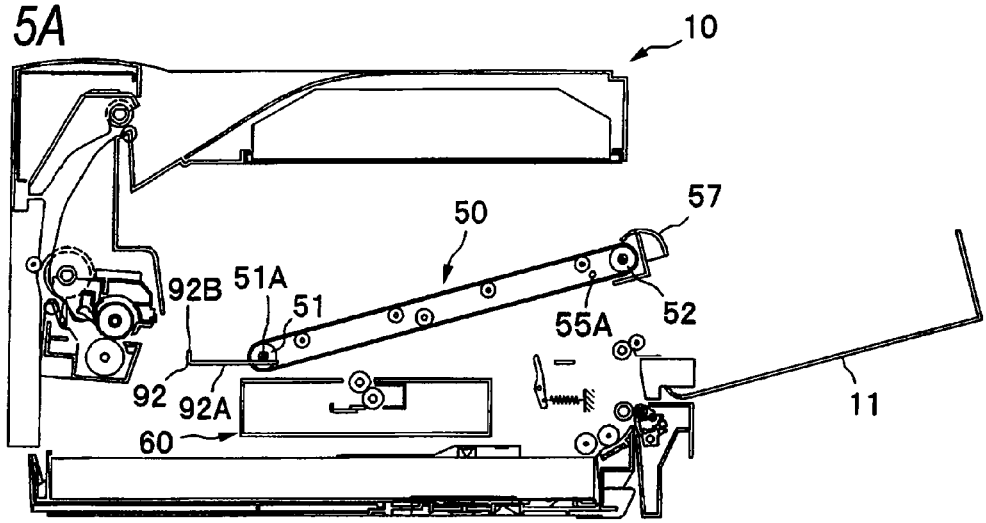
FIGS. 5A to 5C are explanatory views for explaining the process of mounting the belt unit to an apparatus body.
Figure 5B:
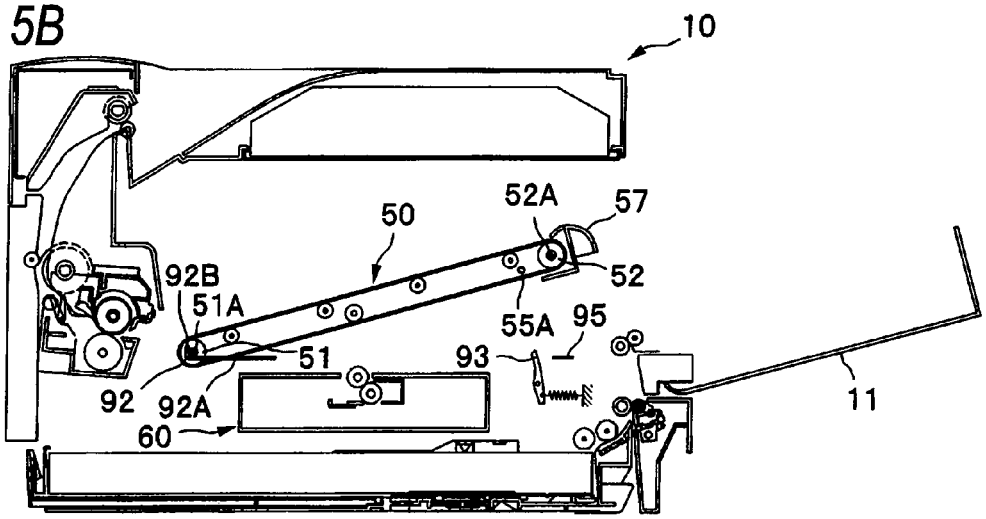

As shown in FIG. 5A, when the belt unit 50 is mounted in the apparatus body, the front cover 11 is opened and, in a state where the image forming apparatus 40 is removed out of the apparatus body, the belt unit 50 is inserted into the apparatus body so that the driving roller 51 side goes at first. At this time, the insertion is performed in a state where the driving roller 51 on a front side with respect to the handle 57 is slightly lowered. Then, as shown in FIG. 5B, in a state where the bearing 51A of the driving roller 51 is put on the rail section 92A of the positioning rail 92, the bearing 51A slides on the rail section 92A toward the rear side until the bearing 51A abuts on the abutting section 92B.

Figure 5C:
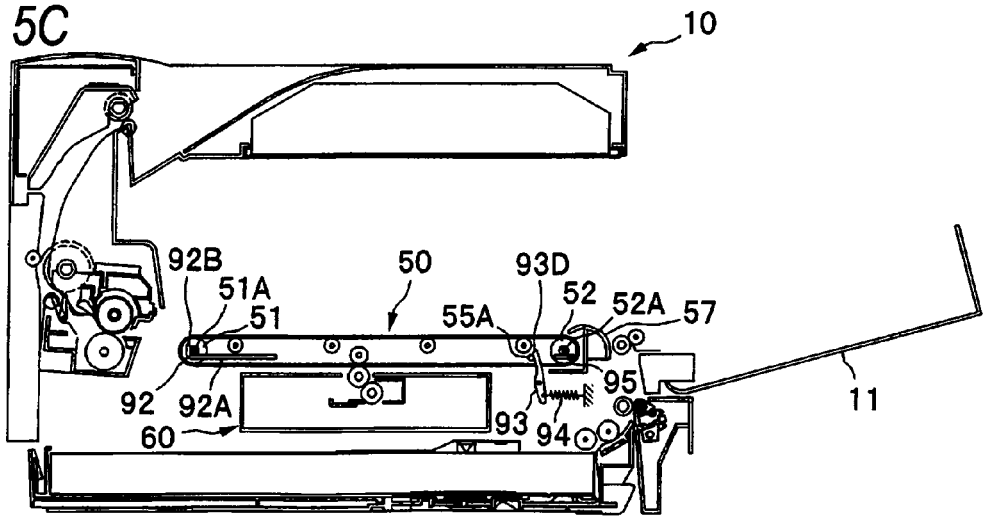

After the bearing 51A has abutted on the abutting section 92B, the handle 57 is lowered downward. And, as shown in FIG. 5C, the lock pin 55A abuts on the upper end face 93D of the lock member 93 and the first arm 93A is pressed toward the front side. When the handle 57 is lowered until the bearing 52A abuts on the support base 95, the position of the belt unit 50 in the upper-lower direction is defined. As the spring 94 pulls the second arm 93B of the lock member 93 toward the front side, the first arm 93A pushes the lock pin 55A toward the rear side and the bearing 51A abuts on the abutting section 92B without any gap therebetween, whereby the position of the belt unit 50 in the front-rear direction is defined.

When the image forming unit 40 is mounted in the apparatus body and printing starts, the photosensitive drum 43, the belt driving gear 91 and the cleaning roller 61 are rotated. If the photosensitive drum 43 starts to move at a timing earlier than the transport belt 53 or if the peripheral speed of the photosensitive drum 43 is larger than that of the transport belt 53, the photosensitive drum 43 presses the upper belt 53A via the sheet P toward the rear side. Unlike a related art, this force causes the bearing 51A to abut on the abutting section 92B. Accordingly, with the movement of the photosensitive drum 43, the position of the belt unit 50 in the front-rear direction is securely defined and does not become unstable.

The direction in which the belt driving gear 91 presses the driving roller gear 51C is a rearward and downward oblique direction, and this force presses the bearing 51A against the rail section 92A and the abutting section 92B. Accordingly, even with the movement of the belt driving gear 91, the position of the belt unit 50 in the upper-lower direction and in the front-rear direction becomes stable.

In addition, when the cleaning roller 61 rotates, the cleaning roller 61 presses the lower belt 53B toward a rear side so that the entire belt unit 50 is pushed toward a rear side. This force also stabilizes the position of the belt unit 50 in the front-rear direction by pressing the bearing 51A against the abutting section 92B.

As described above, according to the color printer 1 according to the illustrative embodiment, since any of forces applied to the belt unit 50 by the photosensitive drum 43, the belt driving gear 91 and the cleaning roller 61 acts to press the bearing 51A against the abutting section 92B, the position of the belt unit 50 in the front-rear direction becomes stable, so that a printing position with respect to the sheet P becomes accurate, and the color shift is suppressed. In particular, if the peripheral speed of the photosensitive drum 43 is larger than that of the transport belt 53, the photosensitive drum 43 always presses the belt unit 50, so that the effect of stabilizing the position of the belt unit 50 in the front-rear direction becomes higher.

In this illustrative embodiment, since the bearing 51A of the driving roller 51 to which a large force is applied by the rotational driving is positioned while abutting on the abutting section 92B, the flexing of the belt unit 50 does not likely to affect the position of the belt unit 50 and the positional accuracy can be maintained.

In addition, since the rail section 92A extending in the front-rear direction is provided, it becomes easy to move the bearing 51A to the abutting section 92B, so that the mounting operability of the belt unit 50 to the apparatus body improves.

While the present invention has been shown and described with reference to certain illustrative embodiments thereof, it will be understood by those skilled in the art that various changes in form and details may be made therein without departing from the spirit and scope of the invention as defined by the appended claims.

For example, in the above-described illustrative embodiment, although the positioning of the belt unit 50 in the front-rear direction is performed by causing the bearing 51A of the driving roller 51 to contact the abutting section 92B, the shaft 51B may contact the abutting section 92B.

Figure 6:
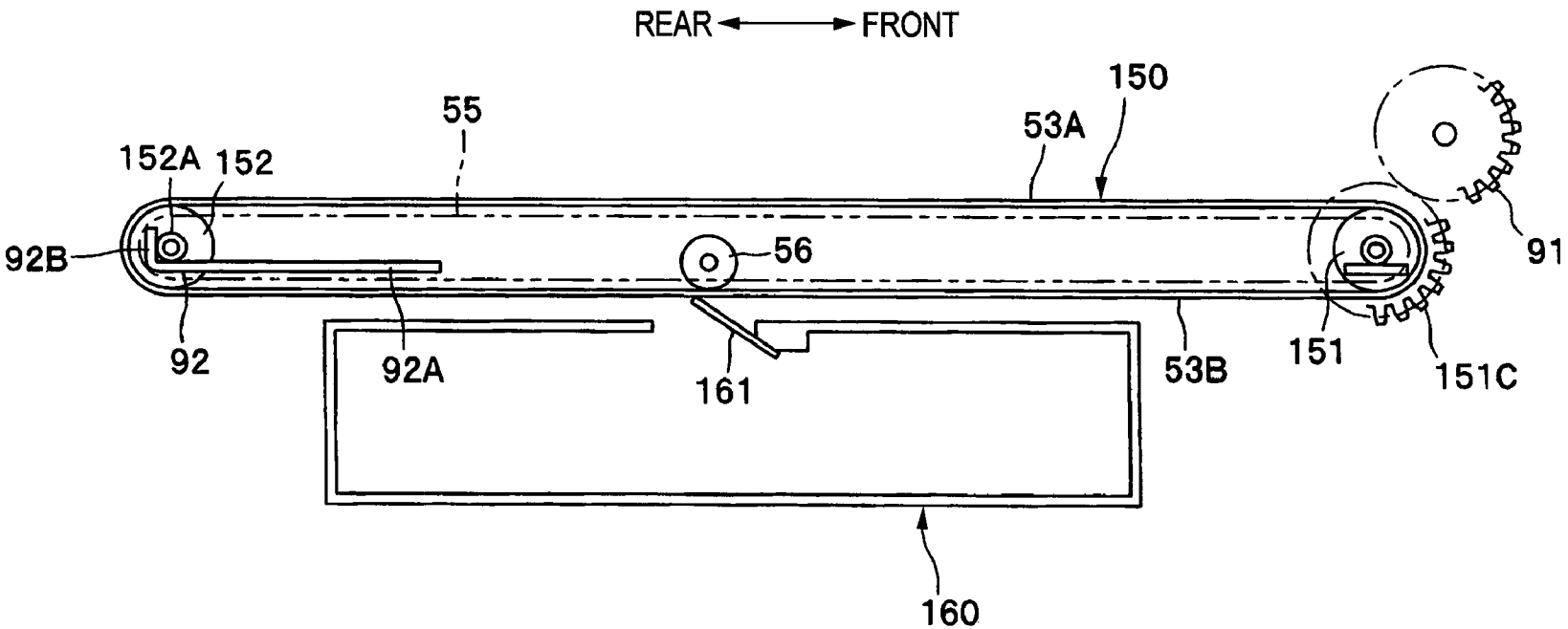
FIG. 6 shows a state in which the configuration of a belt cleaner and a belt driving gear is modified from the illustrative embodiment of FIG. 1.

In addition, in the above-described illustrative embodiment, in order to apply a tension to the upper belt 53A by the force driving the transport belt 53, the driving roller 51 is provided at a rear side and the driven roller 52 is provided at a front side. However, as shown in FIG. 6, a driving roller 151 may be provided at a front side and a driven roller 152 may be provided at a rear side. In this case, it is advantageous that by engaging the belt driving gear 91 with a driving roller gear 151C provided coaxially with the driving roller 151 at an upper and front side, the force with which the belt driving gear 91 is pressing the belt unit 150 via the driving roller gear 151C has a component which presses the bearing 152A of the driven roller 152 against the abutting section 92B.

In addition, the belt cleaner 60 is not limited to the configuration using the cleaning roller 61 as in the above-described illustrative embodiment, and a belt cleaner 160 may be employed which has a blade 161 which contacts the lower belt 53B.

In the above-described illustrative embodiment, the transport belt 53 which transports a sheet P is provided as one example of a belt. However, the belt may be an intermediate transfer belt to which a toner image is temporarily transferred from the photosensitive drum 43.

In addition, in the above-described illustrative embodiment, the color printer 1 is shown as an example of an image forming apparatus. However, the inventive concept of the present invention can also be applied to a monochrome printer, a copy machine, a multifunction machine or the like.

What is claimed is:

1. An image forming apparatus comprising:
a belt unit including:
a driving roller;
a driven roller;
a driving roller gear which is coaxial with the driving roller; and
a belt which is looped around the driving roller and the driven roller;
a belt driving gear which is engaged with the driving roller gear to transmit a driving force to the driving roller;
a photosensitive drum which is configured to rotate while contacting the belt; and
a positioning section which is provided to an apparatus body and includes:
a first positioning section configured to contact a portion of the belt unit to position the belt unit in a moving direction of the belt at a position where the photosensitive drum contacts the belt, and
a second positioning section configured to support the portion of the belt unit from below,
wherein the first positioning section is configured to contact the portion of the belt unit from a direction opposite to a rotating direction of the photosensitive drum at a contacting point with the belt, and
wherein the belt driving gear is engaged with the driving roller gear such that a force pressing the belt unit from the belt driving gear via the driving roller gear presses the portion of the belt unit toward both of the first positioning section and the second positioning section.

2. The image forming apparatus according to claim 1, further comprising:
a belt cleaner configured to contact a surface of the belt to clean the belt at an opposite side to the photosensitive drum.

3. The image forming apparatus according to claim 1, wherein a peripheral speed of the photosensitive drum is larger than a peripheral speed of the belt.

4. The image forming apparatus according to claim 1, wherein the positioning section is configured to position the belt unit by contacting a shaft of the driving roller.

5. The image forming apparatus according to claim 1, wherein the positioning section is configured to position the belt unit by contacting a bearing of the driving roller.

6. The image forming apparatus according to claim 1,
wherein the belt unit is removable from the apparatus body,
the apparatus further comprising a guide configured to guide a shaft or a bearing of the driving roller so as to slide in the moving direction of the belt when mounting the belt unit to the apparatus body.

7. An image forming apparatus comprising:
an apparatus body;
a belt unit including:
a driving roller;
a driven roller;
a driving roller gear which is coaxial with the driving roller; and
a belt which is looped around the driving roller and the driven roller;
a belt driving gear which is provided to the apparatus body and is engaged with the driving roller gear;

a photosensitive drum which is configured to rotate while contacting the belt; and an abutting section which is provided to the apparatus body at a position configured to contact a portion of the belt unit to position the belt unit from a direction opposite to a rotating direction of the photosensitive drum at a contacting point with the belt, wherein the belt driving gear is engaged with the driving roller gear such that a force pressing the belt unit from the belt driving gear via the driving roller gear presses the belt unit toward the abutting section.

8. The image forming apparatus according to claim 7, further comprising:

a lock member which is configured to press a portion of the belt unit toward the abutting section.

9. An image forming apparatus comprising:

a belt unit including:

a driving roller;

a driven roller;

a driving roller gear which is coaxial with the driving roller; and a belt which is looped around the driving roller and the driven roller;

a belt driving gear which is engaged with the driving roller gear to transmit a driving force to the driving roller;

a photosensitive drum which is configured to rotate while contacting the belt;

a belt cleaner including a cleaning roller configured to contact a surface of the belt to clean the belt while rotating; and a positioning section which is provided to an apparatus body and including:

a first positioning section configured to contact a portion of the belt unit to position the belt unit with respect to a moving direction of the belt at a position where the photosensitive drum contacts the belt; and a second positioning section configured to support the portion of the belt unit from below, wherein the first positioning section is configured to contact the portion of the belt unit from a direction opposite to a rotating direction of the photosensitive drum at a contacting point with the belt, wherein the belt driving gear is engaged with the driving roller gear such that a force pressing the belt unit from the belt driving gear via the driving roller gear presses the portion of the belt unit toward both the first positioning section and the second positioning section, and wherein the cleaning roller is configured to contact the belt unit while rotating at an opposite side to the photosensitive drum and rotate in a direction opposite to a rotation direction of the photosensitive drum so as to press the belt unit such that the portion of the belt unit abuts on the first positioning section.

* * * * *